US008876552B2

(12) United States Patent
Taguchi

(10) Patent No.: US 8,876,552 B2
(45) Date of Patent: Nov. 4, 2014

(54) COAXIAL CONNECTOR

(75) Inventor: Hiroyuki Taguchi, Kohtoh-ku (JP)

(73) Assignee: Fujikura Ltd., Tokyo (JP)

( * ) Notice: Subject to any disclaimer, the term of this patent is extended or adjusted under 35 U.S.C. 154(b) by 3 days.

(21) Appl. No.: 13/599,603

(22) Filed: Aug. 30, 2012

(65) Prior Publication Data

US 2012/0322304 A1 Dec. 20, 2012

Related U.S. Application Data

(63) Continuation of application No. PCT/JP2010/072031, filed on Dec. 8, 2010.

(30) Foreign Application Priority Data

Mar. 30, 2010 (JP) ..... 2010-076893

(51) Int. Cl.

| | |
|---|---|
| ***H01R 9/05*** | (2006.01) |
| ***H01R 24/54*** | (2011.01) |
| ***H01R 13/50*** | (2006.01) |
| *H01R 13/11* | (2006.01) |
| *H01R 24/50* | (2011.01) |

(52) U.S. Cl.

CPC ..... *H01R 24/54* (2013.01); *H01R 13/112* (2013.01); *H01R 24/50* (2013.01); *H01R 13/501* (2013.01)

USPC ..... 439/582

(58) Field of Classification Search

USPC ..... 438/582, 578–581, 583–585, 66; 174/59

See application file for complete search history.

(56) References Cited

U.S. PATENT DOCUMENTS

| | | | | |
|---|---|---|---|---|
| 5,662,480 | A | 9/1997 | Togashi | |
| 6,503,100 | B2 * | 1/2003 | Yamane | 439/582 |
| 6,508,668 | B1 | 1/2003 | Yamane | |
| 6,712,645 | B1 * | 3/2004 | Chou | 439/582 |
| 6,739,907 | B2 * | 5/2004 | Kuroda et al. | 439/582 |
| 7,204,715 | B2 * | 4/2007 | Kukita | 439/582 |
| 2002/0155755 | A1 | 10/2002 | Yamane | |
| 2003/0178219 | A1 | 9/2003 | Kuroda et al. | |
| 2003/0181100 | A1 | 9/2003 | Kuroda et al. | |
| 2006/0094297 | A1 * | 5/2006 | Wang | 439/578 |

FOREIGN PATENT DOCUMENTS

| | | | |
|---|---|---|---|
| CN | 1495973 | A | 5/2004 |
| CN | 201360091 | Y | 12/2009 |
| JP | 8-17523 | A | 1/1996 |
| JP | 2001-43939 | A | 2/2001 |
| JP | 2003-282194 | A | 10/2003 |

OTHER PUBLICATIONS

Office Action issued by the Chinese Patent Office in Chinese Application No. 201080062489.5 mailed May 5, 2014.

* cited by examiner

*Primary Examiner* — Renee Luebke
*Assistant Examiner* — Harshad Patel
(74) *Attorney, Agent, or Firm* — Sughrue Mion, PLLC

(57) ABSTRACT

A coaxial connector includes a contact, a housing, and a ground shell. The contact includes a first wall portion in which an insertion groove into which an inner conductor of a coaxial cable is to be inserted is formed. The housing includes a body portion in which an accommodation hole which accommodates the contact is formed and a middle cover portion which closes the housing hole. A surface on the rear-end side of the middle cover portion and a surface on the rear-end side of the first wall portion substantially overlap with each other in a plan view thereof.

3 Claims, 11 Drawing Sheets

COAXIAL CONNECTOR

CROSS REFERENCE TO RELATED APPLICATIONS

This application is a Continuation application base on PCT Patent Application No. PCT/JP2010/072031 filed on Dec. 8, 2010, which claims priority from Japanese Patent Application No. 2010-076893, filed on Mar. 30, 2010, the contents of all of which are incorporated herein by reference in their entirety.

TECHNICAL FIELD

The present invention relates to an L-type coaxial connector attached to a coaxial cable.

This application claims priority from Japanese Patent Application No. 2010-076893, filed on Mar. 30, 2010 and International Patent Application No. PCT/JP2010/72031, filed on Dec. 8, 2010, the entire contents of which are incorporated by reference herein.

BACKGROUND ART

An example of the L-type coaxial connector which includes a terminal, an insulator, and an outer conductor, and in which a contact portion of the terminal is accommodated in a hollow portion of the insulator, a wire-connection portion of the terminal is placed on the upper surface on both sides of the hollow portion, and a middle cover portion of the insulator is bent so as to be parallel to the upper surface is known (for example, refer to Patent Literature 1 (in particular, paragraphs 0024 to 0026 and FIG. 2)).

CITATION LIST

Patent Literature

[Patent Literature 1] Japanese Patent Application Laid-Open No. 2001-43939

DISCLOSURE OF THE INVENTION

Problem to be Solved by the Invention

The above coaxial connector has a structure that the middle cover portion of the insulator also covers an insulating layer of a coaxial cable. Thus, since the height of the entire insulator including the middle cover portion depends on the diameter of the coaxial cable, there is a limit in realizing a low profile of the coaxial connector.

An object of the present invention is to provide a coaxial connector in which a low profile can be realized.

Means for Solving Problem

[1] A coaxial connector according to the present invention comprising: a signal conductor which is to be electrically connected to an inner conductor of a coaxial cable; a ground conductor which is to be electrically connected to an outer conductor of the coaxial cable; and an insulator which holds the signal conductor and which is interposed between the signal conductor and the ground conductor, wherein the signal conductor includes a first wall portion in which an insertion portion into which the inner conductor is to be inserted is formed, the insulator includes: a body portion in which an accommodation hole which accommodates the signal conductor is formed; and a middle cover portion which closes the accommodation hole, and a rear end-side surface of the middle cover portion and a rear end-side surface of the first wall portion substantially overlap each other in a plan view.

[2] In the above invention, a contact surface of the first wall portion which contacts the middle cover portion may be substantially on the same plane as an opposing surface of the body portion facing the middle cover portion or may protrude toward the middle cover portion farther than the opposing surface.

[3] In the above invention, the signal conductor may include: a base portion which supports the first wall portion; a second wall portion which protrudes from the base portion in substantially the same direction as the first wall portion; and a fitting portion which protrudes from the base portion in a direction opposite to the first wall portion, the first wall portion may be positioned closer to a rear end side than the fitting portion in a plan view and may be disposed at least at both ends of the base portion in a direction substantially orthogonal to an axial direction of the coaxial cable, the second wall portion may be positioned closer to a distal end side than the fitting portion in a plan view thereof and may be disposed at least at both sides of the base portion in a direction substantially orthogonal to the axial direction of the coaxial cable, and the accommodation hole may have a stepped surface which holds a main surface of the base portion opposite to a protruding direction of the first wall portion and the second wall portion.

[4] In the above invention, the middle cover portion may be connected to the body portion so as to be able to perform a hinge operation about a direction substantially parallel to an axial direction of the coaxial cable.

Effect of the Invention

According to the present invention, since the rear end-side surface of the middle cover portion and the rear end-side surface of the first wall portion substantially overlap with each other in a plan view thereof, it is possible to offset (shift) the middle cover portion and the insulating layer of the coaxial cable from each other and to realize a low profile of the coaxial connector.

BEST MODE FOR CARRYING OUT THE INVENTION

Hereinafter, embodiments of the present invention will be described based on the drawings.

Figure 1:
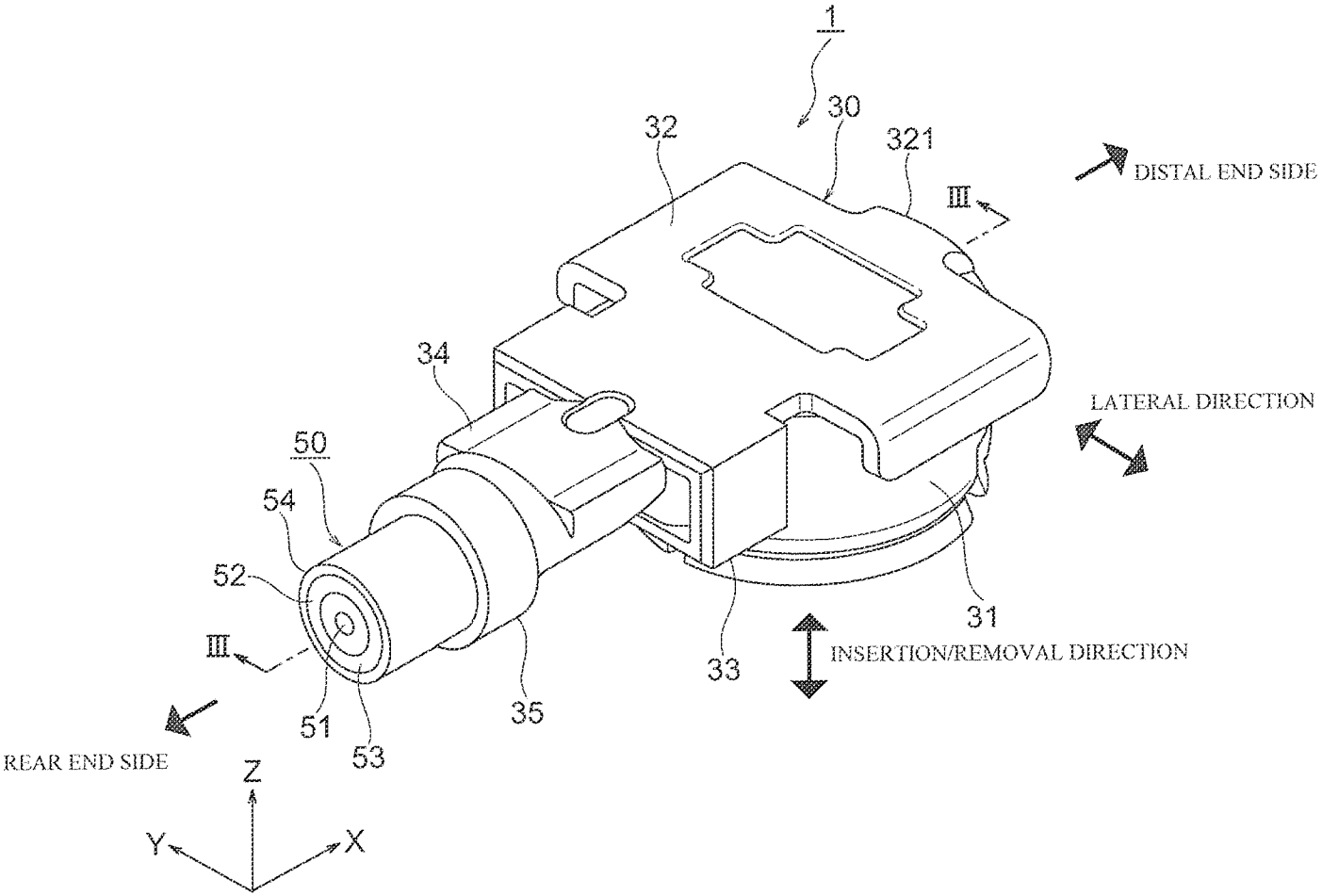
FIG. 1 is a perspective view illustrating an entire coaxial connector in an embodiment of the present invention.
Figure 2:
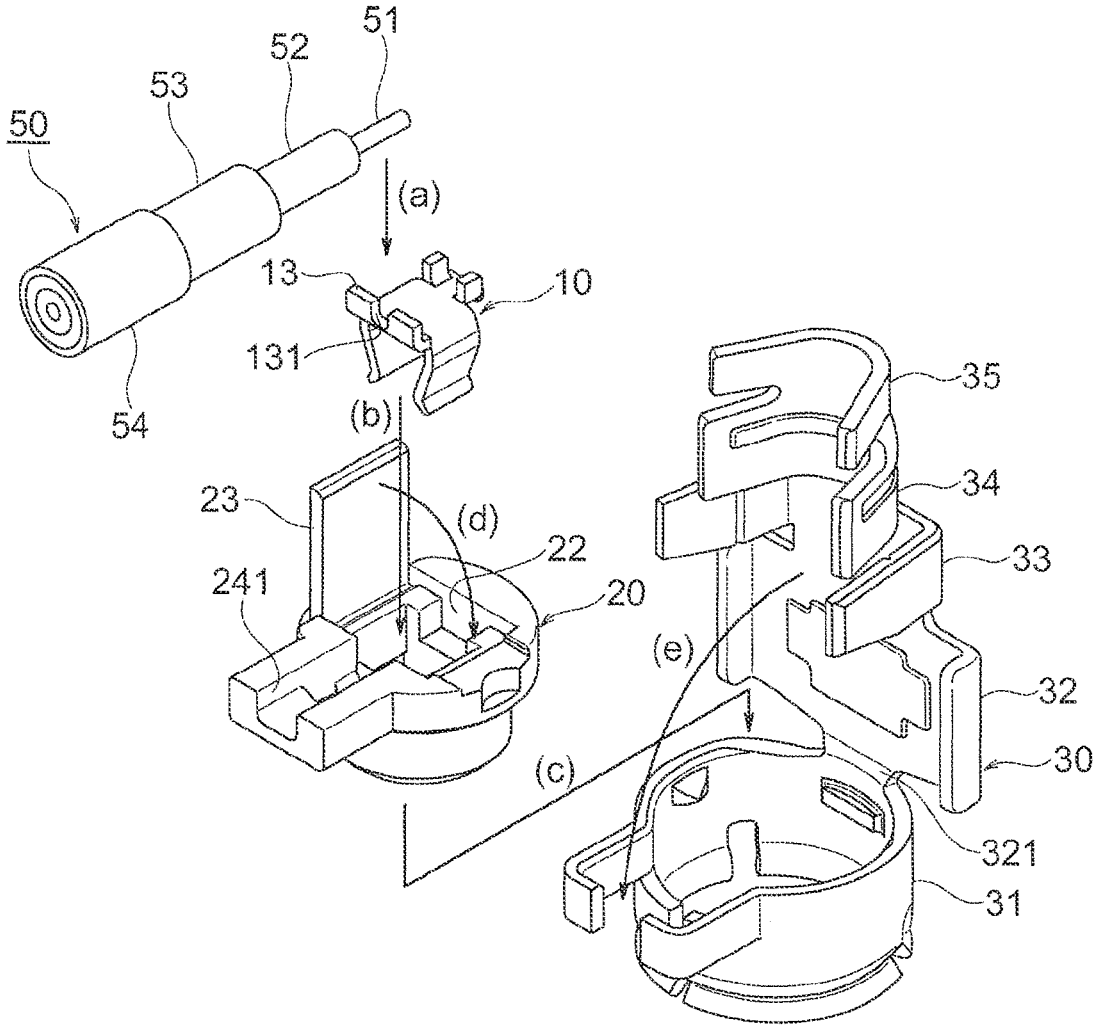
FIG. 2 is an exploded perspective view of the coaxial connector illustrated in FIG. 1.
Figure 3:
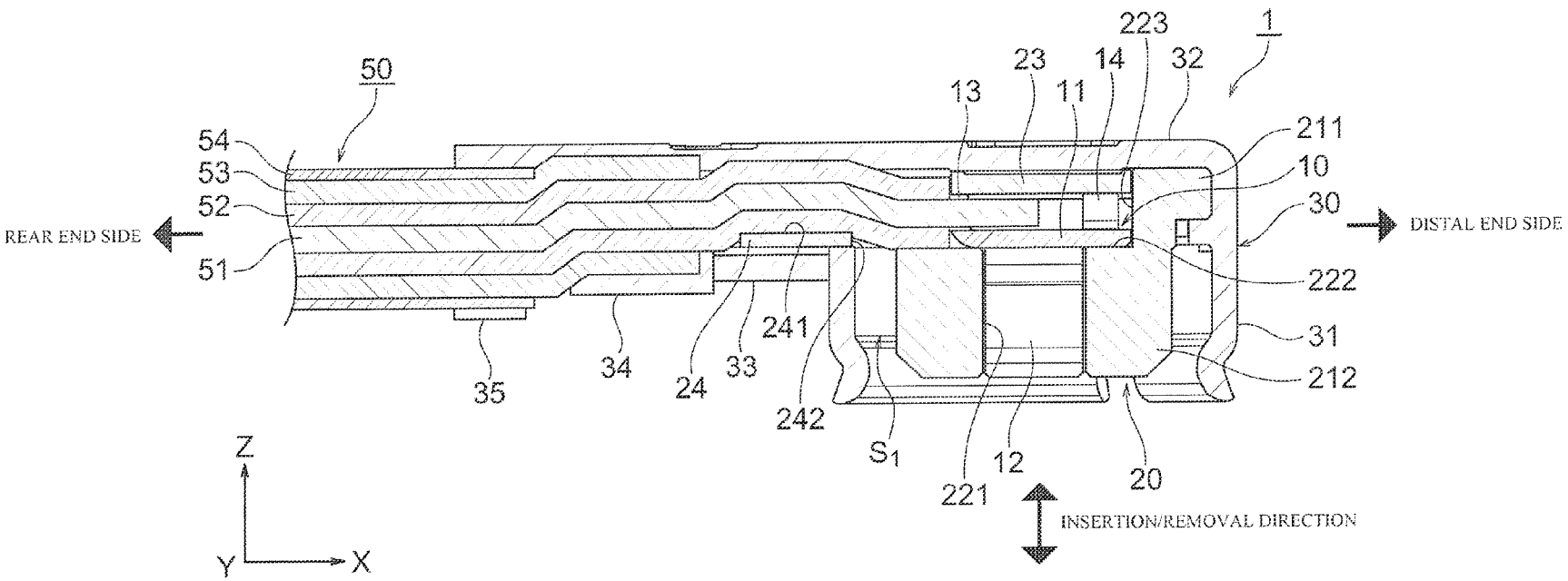
FIG. 3 is a cross-sectional view taken along the line III-III of FIG. 1.
Figure 4A:
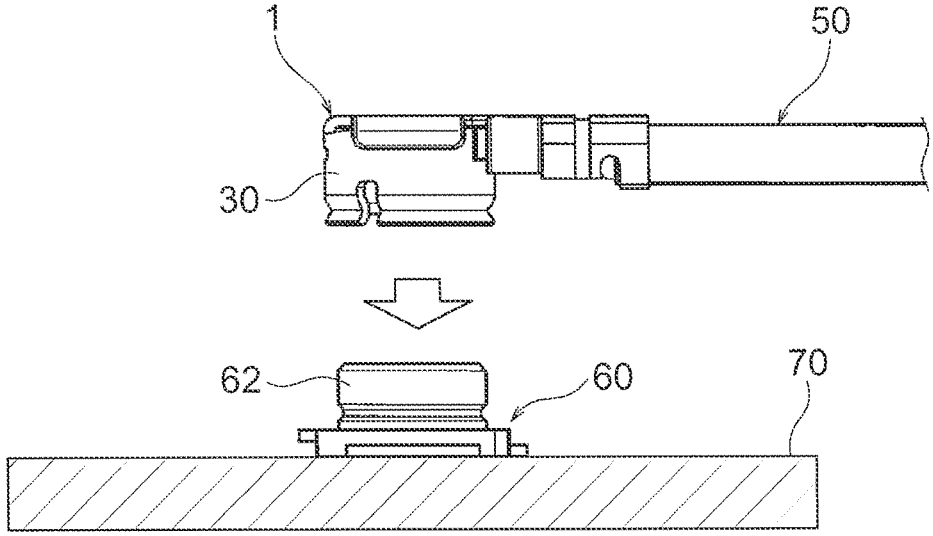
FIG. 4A is a side view illustrating an operation (before fitting) of fitting the coaxial connector in the embodiment of the present invention.
Figure 4B:
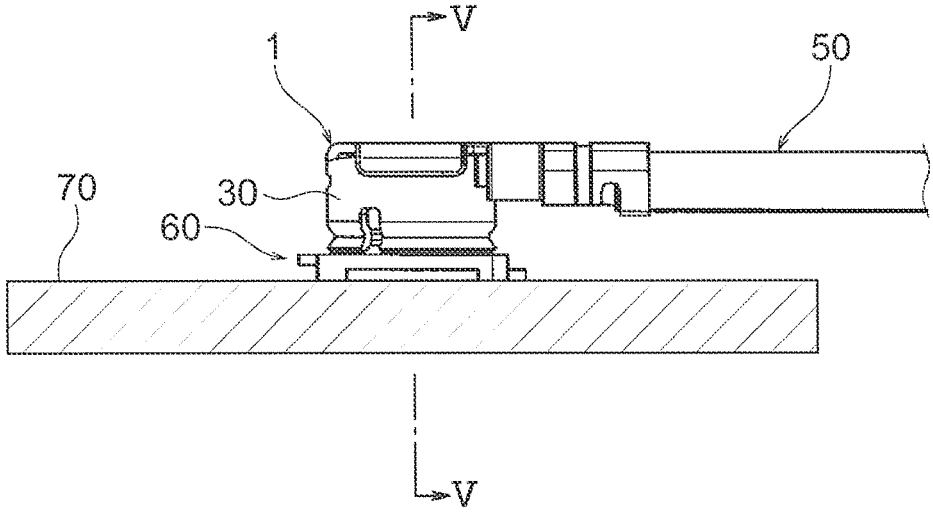
FIG. 4B is a side view illustrating an operation (after fitting) of fitting the coaxial connector in the embodiment of the present invention.
Figure 5:
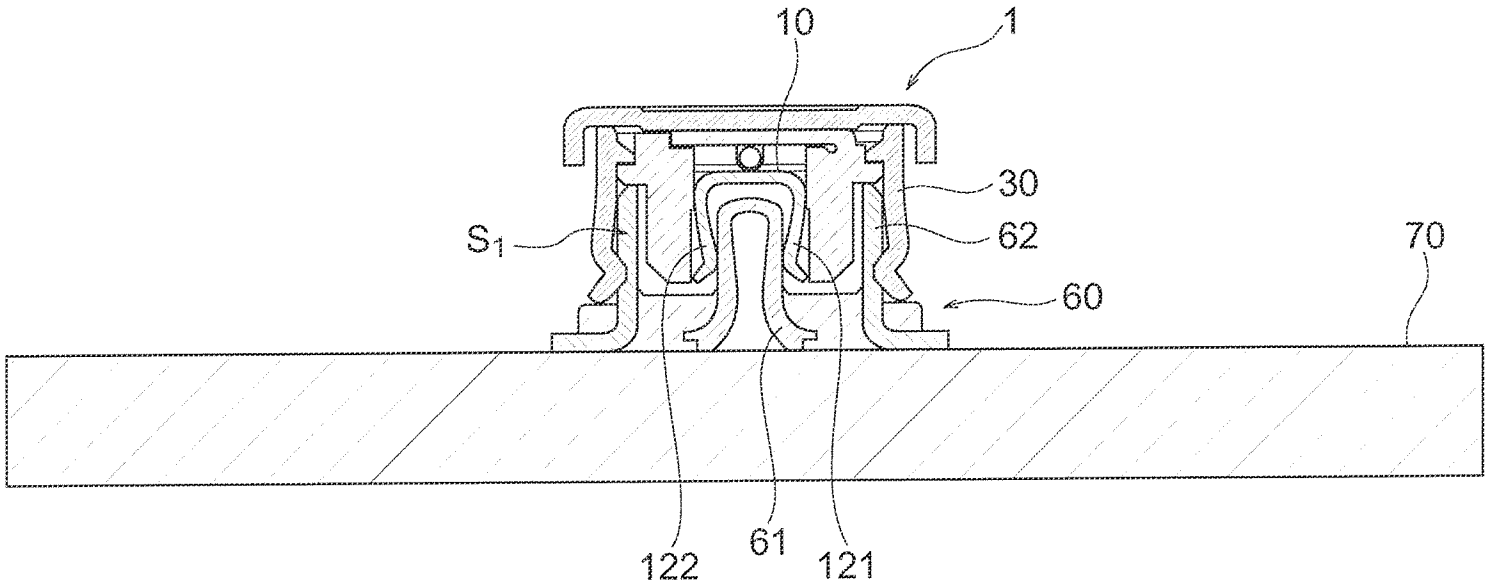
FIG. 5 is a cross-sectional view taken along the line V-V of FIG. 4B.

FIGS. 1 to 3 are views illustrating a coaxial connector in the present embodiment, and FIGS. 4A to 5 are views illustrating an operation of fitting the coaxial connector in the present embodiment.

As illustrated in FIGS. 1 to 3, a coaxial connector 1 of the present embodiment is an L-type coaxial connector attached to an end portion of a coaxial cable 50. As illustrated in FIGS. 4A, 4B and 5, the coaxial connector 1 is configured to be fitted to a coaxial connector 60 (hereinafter simply referred to as a counterpart connector 60) of a surface mount technology (SMT) type, for example. The coaxial connector 1 is used in various electronic devices of a mobile information processing terminal equipped with a communication antenna such as a mobile phone, a personal digital assistant (PDA), or a notebook computer. Examples of a circuit wiring board 70 on which the counterpart connector 60 is mounted include a flexible substrate (FPC: Flexible Printed Circuit) or a rigid printed wiring board (PCB: Printed Circuit Board).

In the present embodiment, "rear end side" means a side where the coaxial cable 50 is led from the coaxial connector 1 in an axial direction (the X direction in the drawing) of the coaxial cable 50. In contrast, "distal end side" means a side where an end portion of the coaxial cable 50 is introduced into the coaxial connector 1 in the axial direction (the X direction in the drawing) of the coaxial cable 50. Moreover, "lateral direction" means a direction (the Y direction in the drawing) that is substantially orthogonal to the axial direction (the X direction in the drawing) of the coaxial cable 50 and that is substantially orthogonal to an insertion/removal direction (the Z direction in the drawing) of the coaxial connector 1.

As illustrated in FIGS. 1 to 3, the coaxial cable 50 includes an inner conductor 51, an insulating layer 52 covering the outer periphery of the inner conductor 51, an outer conductor 53 (so called a shield line) surrounding the outer periphery of the insulating layer 52, and a protective layer 54 covering the outer periphery of the outer conductor 53.

On the other hand, as illustrated in the drawings, the coaxial connector 1 of the present embodiment includes: a contact 10 which is to be electrically connected to the inner conductor 51 of the coaxial cable 50; a ground shell 30 which is to be electrically connected to the outer conductor 53 of the coaxial cable 50; and a housing 20 interposed between the contact 10 and the ground shell 30 so as to electrically isolate the contact 10 and the ground shell 30 from each other.

The contact 10 of the present embodiment corresponds to an example of a signal conductor of the present invention, the housing 20 of the present embodiment corresponds to an example of an insulator of the present invention, and the ground shell 30 of the present embodiment corresponds to an example of a ground conductor of the present invention.

Figure 6:
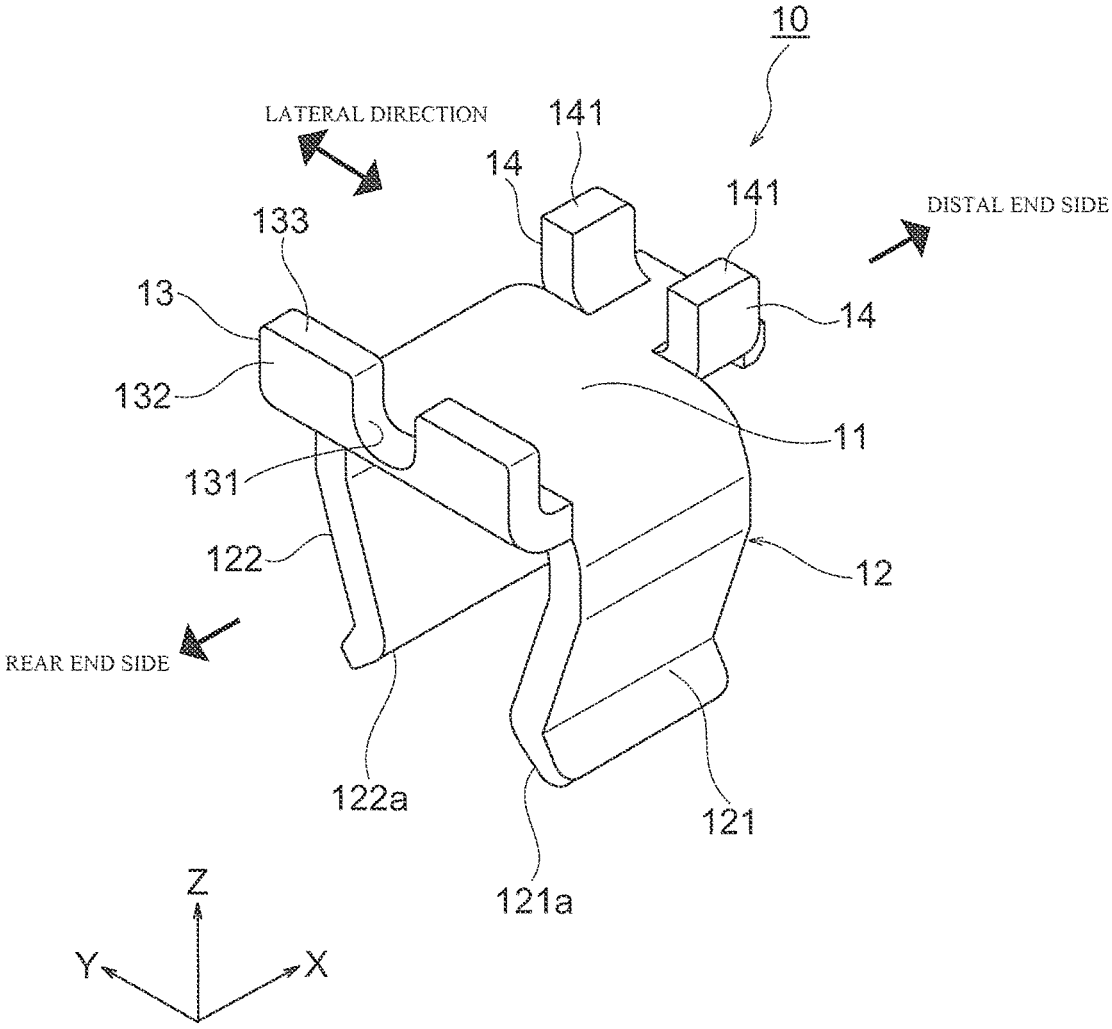
FIG. 6 is a perspective view of a contact in the embodiment of the present invention.

FIG. 6 is a perspective view of the contact of the present invention.

As illustrated in FIG. 6, the contact 10 of the coaxial connector 1 includes a base portion 11, a fitting portion 12, a first wall portion 13, and a second wall portion 14.

The contact 10 is obtained by processing one metal plate so that the base portion 11, the fitting portion 12, and the wall portions 13 and 14 are formed to be continuous. Examples of a material constituting the contact 10 include phosphor bronze, beryllium copper, brass, stainless steel, titanium copper alloy, and the like. Preferably, gold plating is formed on the surface thereof.

The fitting portion 12 comprises a pair of contact pieces 121 and 122 which protrude downward from both left and right ends (both ends in the lateral direction (the Y direction in the drawing)) of the base portion 11. The contact pieces 121 and 122 are curved so as to approach each other as they advance toward the distal ends thereof. The contact pieces 121 and 122 have an approximately U-shaped cross-sectional shape as a whole. Furthermore, tapered portions 121*a* and 122*a* curved so as to stretch outward away from each other are formed at the distal ends of the contact pieces 121 and 122. A fitting portion 61 (see FIG. 5) of the counterpart connector 60 is guided into the space between the contact pieces 121 and 122 when the coaxial connector 1 and the counterpart connector 60 are fitted to each other.

The first wall portion 13 protrudes upward from the rear end edge of the base portion 11 and is positioned closer to the rear end side than the fitting portion 12 in a plan view (see FIG. 9) in which the contact 10 is viewed from above. Moreover, the first wall portion 13 is provided over the entire region in the lateral direction (the Y direction in the drawing) of the base portion 11. Moreover, the height of the first wall portion 13 from a lower surface 111 of the base portion 11 is set to $h_1$ (see FIG. 8). Furthermore, an insertion groove 131 is formed in the first wall portion 13 so that an inner conductor 51 of the coaxial cable 50 is inserted.

When an end surface of the insulating layer 52 of the coaxial cable 50 is brought into contact with the first wall portion 13, positioning of the coaxial cable 50 relative to the contact 10 is carried out. Furthermore, in a state where the inner conductor 51 exposed from the insulating layer 52 is inserted into the insertion groove 131, when the inner conductor 51 is soldered to the base portion 11, wire-connection between the coaxial cable 50 and the contact 10 is carried out. An insertion hole may be formed in the first wall portion 13 instead of the insertion groove 131. The insertion groove 131 and the insertion hole correspond to an example of an insertion portion of the present invention.

A pair of second wall portions 14 protrudes upward from the vicinity of the distal end of the base portion 11 and is positioned closer to the distal end side than the fitting portion 12 in a plan view (see FIG. 9) in which the contact 10 is viewed from the above. Moreover, the second wall portion 14 is positioned at both ends in the lateral direction (the Y direction in the drawing) of the base portion 11. The second wall portion 14 has substantially the same height $h_2$ as the height $h_1$ of the first wall portion 13 (see FIG. 8).

In the present embodiment, since the first wall portion 13 and the second wall portion 14 are positioned at four corners of the base portion 11, the contact 10 can be stably pressed by a middle cover portion 23 described later, of the housing 20.

Moreover, although the contact 10 of the present embodiment has very small dimensions of about a few mm, since the first wall portion 13 and the second wall portion 14 are positioned at four corners of the base portion 11, it becomes easy for an operator to handle the contact 10. Thus, the assembling workability of the coaxial connector 1 is improved.

Furthermore, since the die for molding the housing 20 is less expensive as compared with a case where a protruding portion is formed in the middle cover portion 23 of the housing 20 instead of the first wall portion 13 and the second wall portion 14, it is also possible to decrease the cost of the coaxial connector 1.

Figure 7:
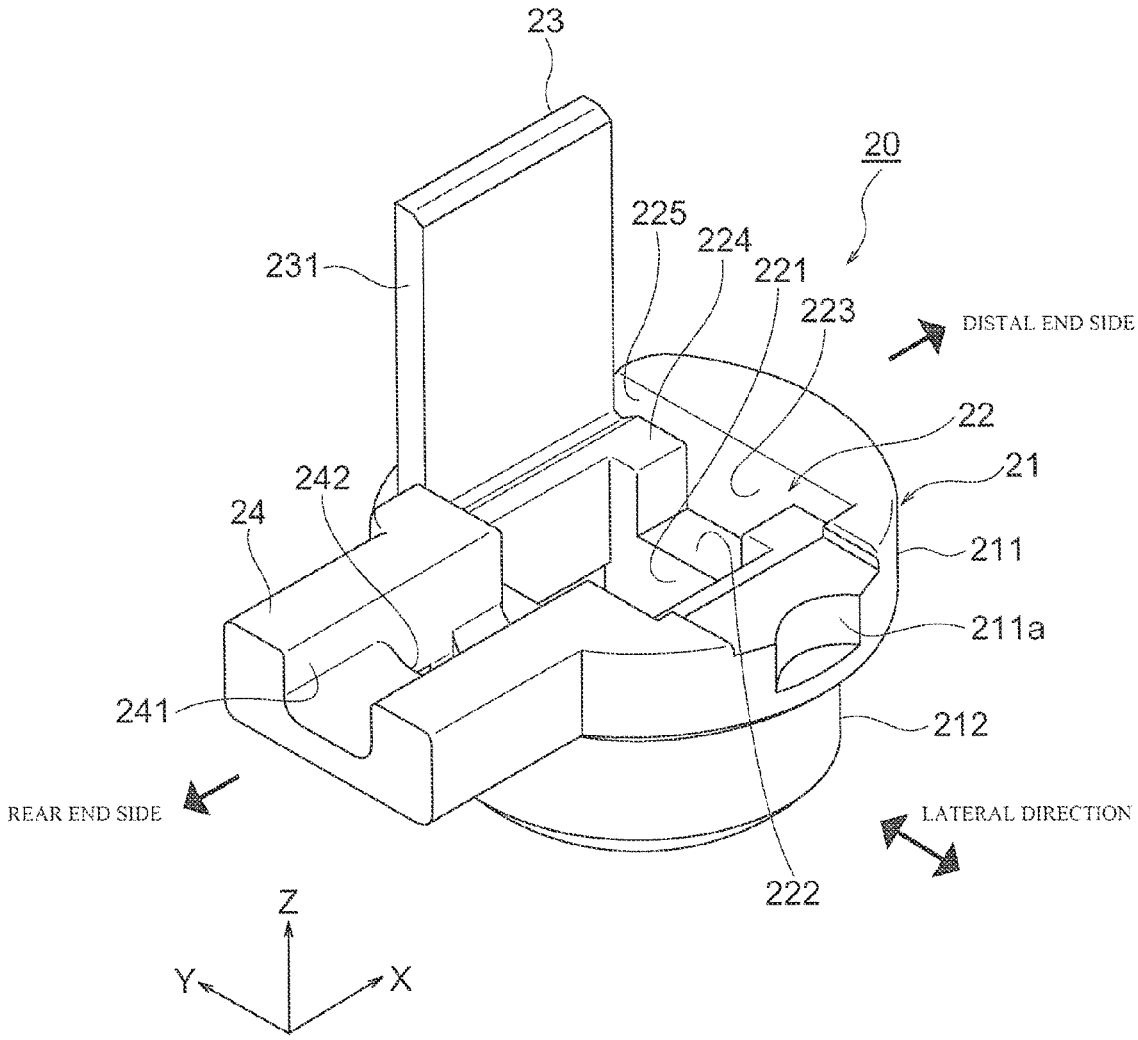
FIG. 7 is a perspective view of a housing in the embodiment of the present invention.
Figure 8:
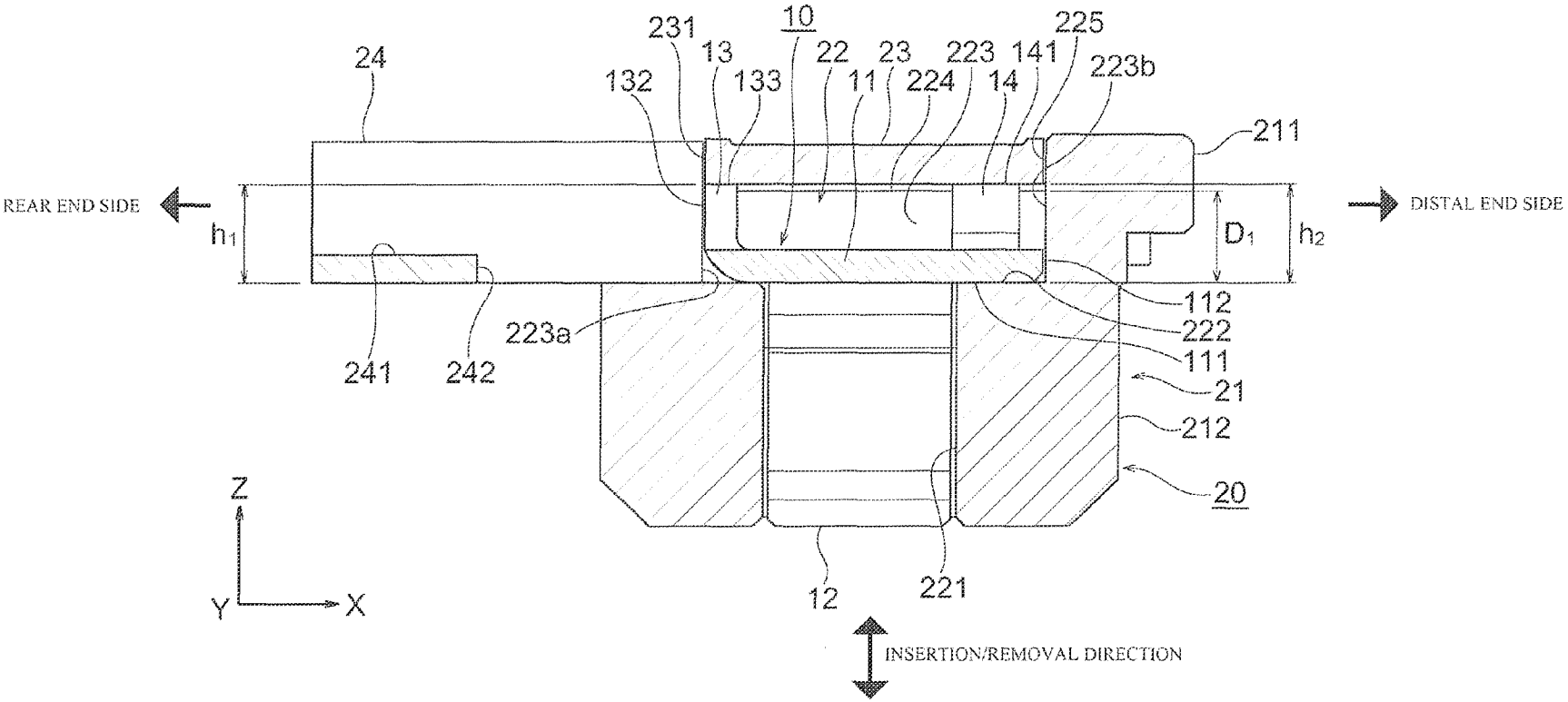
FIG. 8 is a cross-sectional view illustrating the relation between a housing and the contact in the embodiment of the present invention.
Figure 9:
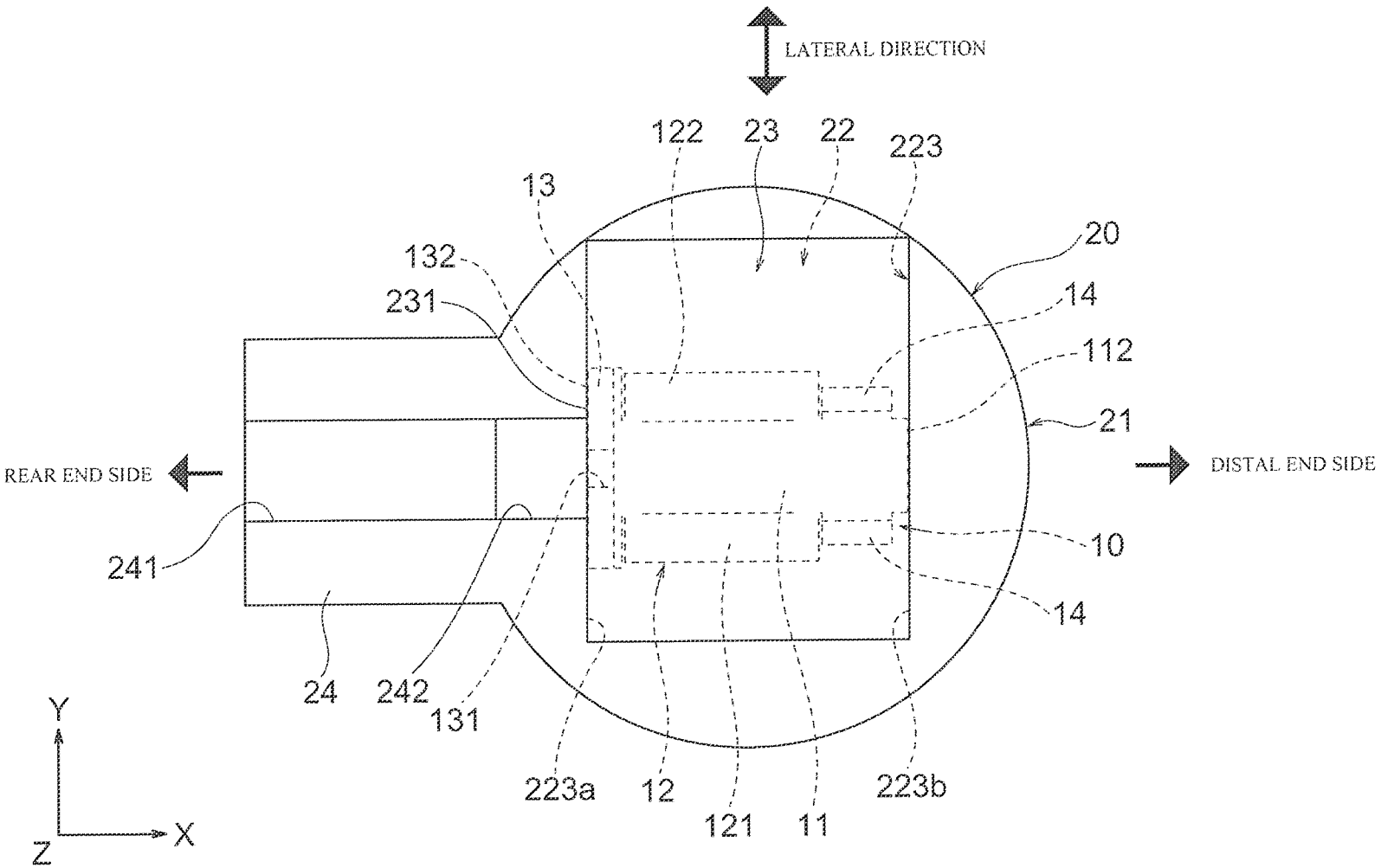
FIG. 9 is a plan view illustrating the relation between the housing and the contact in the embodiment of the present invention.

FIG. 7 is a perspective view of the housing in the present embodiment, and FIGS. 8 and 9 are views illustrating the relation of the contact and the housing in the present embodiment. FIGS. 8 and 9 illustrate a state where the middle cover portion 23 is closed.

As illustrated in FIG. 7, the housing 20 of the coaxial connector 1 includes: a body portion 21 in which an accommodation hole 22 is formed so that the contact 10 is accommodated therein; the middle cover portion 23 configured to close the accommodation hole 22; and a cable holding portion 24 configured to protrude from the body portion 21 toward the rear end side.

The housing 20 is composed of a resin material having electrically isolating properties such as poly butylene terephthalate (PBT) or liquid crystal polymer (LCP), for example.

The body portion 21 includes: a flange portion 211 that is disposed on an upper portion thereof so as to protrude in a radial direction; and a small-diameter portion 212 that is disposed on a lower portion thereof and has a smaller diameter than the flange portion 211. Moreover, concave portions 211*a* are formed on the side surfaces of the flange portion 211. When the housing 20 is inserted into the ground shell 30, the flange portion 211 is held in a protrusion 312 of the ground shell 30, and convex portions 313 of the ground shell 30 engage with the concave portion 211*a* of the flange portion 211.

As illustrated in FIGS. 7 and 8, the accommodation hole 22 formed approximately at the center of the body portion 21 includes a first accommodating portion 221, a second accommodating portion 223, and a third accommodating portion 225, and penetrates through the body portion 21 in the vertical direction. The fitting portion 12 of the contact 10 is accommodated in the first accommodating portion 221. The base portion 11 and the wall portions 13 and 14 of the contact 10 are accommodated in the second accommodating portion 223. The middle cover portion 23 is accommodated in the third accommodating portion 225.

When the contact 10 is accommodated in the accommodation hole 22, although an opening on the upper side (the third accommodating portion 225 side) of the accommodation hole 22 is closed by the middle cover portion 23, the fitting portion 11 of the contact 10 is exposed from an opening on the lower side (the first accommodating portion 221 side) of the accommodation hole 22.

As illustrated in FIGS. 7 and 8, the inner diameter of the second accommodating portion 223 is larger than the inner diameter of the first accommodating portion 221 in the axial direction (the X direction in the drawing) of the coaxial cable 50. Thus, a first stepped surface 222 is formed between the second accommodating portion 223 and the first accommodating portion 221, the fitting portion 12 of the contact 10 is accommodated in the first accommodating portion 221, and the base portion 11 of the contact 10 is held in the first stepped surface 222. The first stepped surface 222 of the present embodiment corresponds to an example of a stepped surface of the present invention.

As illustrated in FIG. 8, when the base portion 11 of the contact 10 is placed on the first stepped surface 222, a rear end-side surface 132 of the first wall portion 13 of the contact 10 comes into contact with a rear end-side inner wall surface 223*a* of the second accommodating portion 223. Moreover, a distal end surface 112 of the base portion 11 comes into contact with a distal end-side inner wall surface 223*b* of the second accommodating portion 223.

As above, in the present embodiment, since the contact 10 is caught between the inner wall surfaces 223*a* and 223*b* of the second accommodating portion 223, rattling of the contact 10 in the axial direction (the X direction in the drawing) of the coaxial cable 50 is suppressed.

As illustrated in FIG. 7, the inner diameter of the third accommodating portion 225 is larger than the inner diameter of the second accommodating portion 223 in the lateral direction (the Y direction in the drawing). Thus, a second stepped surface 224 is formed between the third accommodating portion 225 and the second accommodating portion 223. The second stepped surface 224 faces the middle cover portion 23 when the middle cover portion 23 is folded toward the body portion 21. The second stepped surface 224 corresponds to an example of an opposing surface of the present invention.

The middle cover portion 23 of the housing 20 is connected to the body portion 21 so as to be able to perform a hinge operation about a direction substantially parallel to the axial direction (the X direction in the drawing) of the coaxial cable 50. The middle cover portion 23 is a little smaller than the third accommodating portion 225 of the accommodation hole 22, and the middle cover portion 23 is accommodated in the third accommodating portion 225 when the middle cover portion 23 is folded toward the body portion 21.

In the present embodiment, in the plan view illustrated in FIG. 9, in a state where the middle cover portion 23 is accommodated in the third accommodating portion 225, the rear end-side surface 231 of the middle cover portion 23 and the rear end-side surface 132 of the first wall portion 13 of the contact 10 substantially overlap with each other. In other words, the rear end-side surface 231 of the middle cover portion 23 and the rear end-side surface 132 of the first wall portion 13 of the contact 10 are located substantially on the same plane.

Thus, since the middle cover portion 23 is offset (shifted) from the insulating layer 52 of the coaxial cable 50 in the plan view, the middle cover portion 23 does not press the insulating layer 52. In this way, it is possible to realize a low profile of the coaxial connector 1 (to decrease the height of the coaxial connector 1) without depending on the diameter of the coaxial cable 50 (more specifically, the diameter of the insulating layer 52 of the coaxial cable 50).

Moreover, when tractive force is applied to the contact 10 via the coaxial cable 50, there is a possibility that the contact 10 rotates about the lateral direction (the Y direction in the drawing) within the accommodation hole 22.

In contrast, in the present embodiment, since the center of rotation of the hinge operation of the middle cover portion 23 is set to the above direction, it is possible to prevent the middle cover portion 23 from being open with the rotation thereof and to reliably fix the contact 10.

Without being limited to the above, the center of rotation of the middle cover portion 23 may be set to a direction (the Y direction in the drawing) substantially orthogonal to the axial direction (the X direction in the drawing) of the coaxial cable 50, for example.

Moreover, in the present embodiment, as illustrated in FIG. 8, the height $h_1$ of the first wall portion 13 and the height $h_2$ of the second wall portion 14 of the contact 10 are a little larger than the depth $D_1$ of the second accommodating portion 223 of the accommodation hole 22 ($h_1=h_2>D_1$). That is, in a state where the contact 10 is accommodated in the accommodation hole 22, the upper surface 133 of the first wall portion 13 and the upper surface 141 of the second wall portion 14 protrude toward the middle cover portion 23 farther than the second stepped surface 224 of the accommodation hole 22.

When the contact 10 rattles in the insertion/removal direction (the Z direction in the drawing), the distance between the contact 10 and the ground shell 30 may change, so that the impedance may change.

In contrast, in the present embodiment, as described above, since the upper surfaces 133 and 141 of the first and second wall portions 13 and 14 are configured to protrude toward the middle cover portion 23 farther than the second stepped surface 224 of the accommodation hole 22, the upper surfaces 133 and 141 of the first and second wall portions 13 and 14 make reliable contact with the middle cover portion 23.

Thus, since the contact 10 is pressed by the middle cover portion 23, the rattling of the contact 10 in the insertion/removal direction (the Z direction in the drawing) is suppressed. In this way, it is possible to stabilize the impedance of the coaxial connector 1, which is particularly effective as the transmission signal frequency increases.

The height $h_1$ of the first wall portion 13 and the height $h_2$ of the second wall portion 14 of the contact 10 may be substantially the same as the depth $D_1$ of the second accommodating portion 223 ($h_1=h_2=D_1$). Moreover, the upper surface 133 of the first wall portion 13 of the present embodiment corresponds to an example of a contact surface of the first wall portion of the present invention.

On the other hand, as described above, the base portion 11 of the contact 10 is held on the first stepped surface 222 of the accommodation hole 22 of the housing 20. More specifically, portions on both sides of a portion from which the fitting portion 12 protrudes in the lower surface 111 of the base portion 11 are placed on the first stepped surface 222. Thus, when the middle cover portion 23 is folded, the base portion 11 and the wall portions 13 and 14 of the contact 10 are caught between the middle cover portion 23 and the first stepped surface 222.

As above, in the present embodiment, as described above, since the base portion 11 and the wall portions 13 and 14 of the contact 10 are caught between the middle cover portion 23 and the first stepped surface 222, it is possible to further suppress the rattling of the contact 10 in the insertion/removal direction (the Z direction in the drawing).

Although the first stepped surface 222 may not need to hold entire portions on both sides of the portion from which the fitting portion 12 protrudes in the lower surface 111 of the base portion 11, when the first stepped surface 222 holds the portions corresponding to the standing portions (erected portions) of the first and second wall portions 13 and 14, it is possible to press the contact 10 appropriately.

The cable holding portion 24 of the housing 20 extends from the body portion 21 toward the rear end side. A guide groove 241 is formed in the cable holding portion 24 so that the coaxial cable 50 is inserted therein.

A penetration hole 242 that penetrates through the cable holding portion 24 is formed in a distal end-side end portion of the guide groove 241. As illustrated in FIG. 3, since the coaxial cable 50 bends due to a difference in height between the guide groove 241 and the penetration hole 242, the coaxial cable 50 is prevented from easily coming out of the coaxial connector 1.

Figure 10:
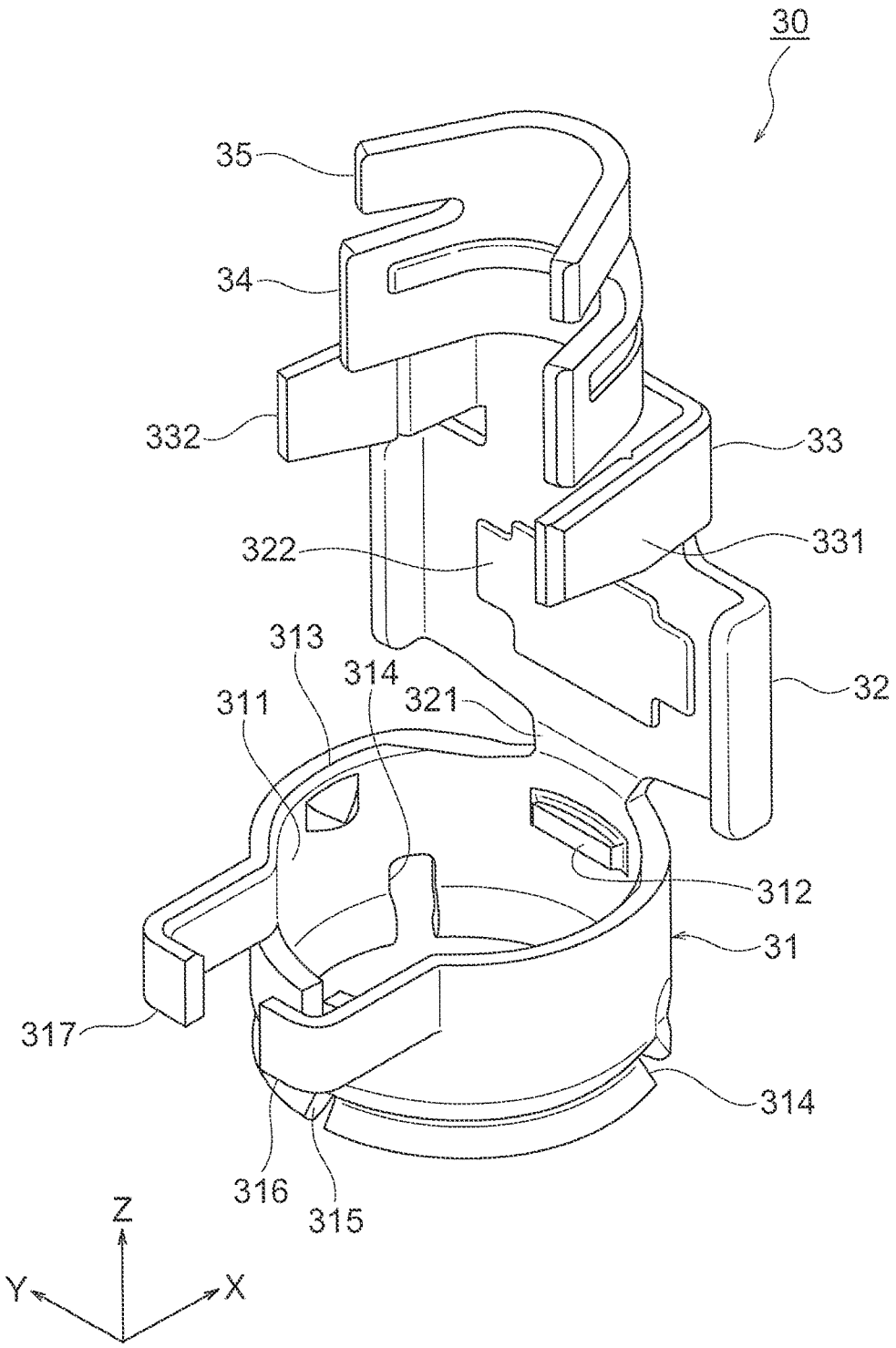
FIG. 10 is a perspective view illustrating a ground shell in the embodiment of the present invention.

FIG. 10 is a perspective view of the ground shell in the present embodiment.

As illustrated in FIG. 10, the ground shell 30 of the coaxial connector 30 includes a cylindrical portion 31, an outer cover portion 32, a first barrel 33, a second barrel 34, and a third barrel 35.

The ground shell 30 is obtained by processing one metal plate so that the cylindrical portion 31, the outer cover portion 32, and the first to third barrels 33 to 35 are formed to be continuous similarly to the contact 10. Examples of a material constituting the ground shell 30 include phosphor bronze, beryllium copper, brass, stainless steel, titanium copper alloy, and the like. Preferably, silver plating or gold plating is formed on the surface thereof.

The cylindrical portion 31 of the ground shell 30 includes an inner hole 311 configured to be able to accommodate the body portion 21 of the housing 20 therein. Moreover, a projection 312 and the convex portions 313 protrude from the inner circumferential surface of the cylindrical portion 31.

As illustrated in FIG. 3, when the housing 20 is inserted into the ground shell 30, the flange portion 211 of the housing 20 is held by the projection 312, and the convex portions 313 engage with the concave portions 211*a* of the housing 20. Moreover, in this state, a gap $S_1$ in which a ground shell 62 (see FIG. 5) of a counterpart connector 60 enters is formed between the small-diameter portion 212 of the housing 20 and the inner circumferential surface of the cylindrical portion 31.

As illustrated in FIG. 10, two slits 314 are formed on the lower circumferential edge of the cylindrical portion 31. Moreover, as described above, since the ground shell 30 is formed by processing one plate member, a gap 315 is formed in a part of the cylindrical portion 31. The slits 314 and the gap 315 allow elastic deformation of the circular cylindrical portion 31, so that the cylindrical portion 31 can engage with the ground shell 62 of the counterpart connector 60 (see FIG. 5). The number of slits 314 and the formation position are not particularly limited.

Furthermore, a pair of arm portions 316 and 317 protrudes toward the rear end side from the upper portion of the cylindrical portion 31. The arm portions 316 and 317 surround the cable holding portion 24 when the housing 20 is inserted into the ground shell 30.

The outer cover portion 32 of the ground shell 30 is connected to the cylindrical portion 31 via a folding portion 321 having a narrow width. When the folding portion 321 is folded, the outer cover portion 32 closes the opening on the upper side of the cylindrical portion 31.

A flat convex portion 322 that bulges inward is formed approximately at the central portion of the outer cover portion 32. When the folding portion 321 is folded, the flat convex portion 322 makes close contact with the middle cover portion 23 of the housing 20 to thereby reliably press the first and second wall portions 13 and 14 of the contact 10 via the middle cover portion 23.

Furthermore, three barrels 33 to 35 are arranged on the rear end side of the outer cover portion 32.

The first barrel 33 is disposed to be adjacent to the outer cover portion 32, and a pair of first projecting pieces 331 and 332 protrudes in the lateral direction (the Y direction in the drawing). The first barrel 33 is folded inward in a state of surrounding the cable holding portion 24 of the housing 20 and the arm portions 316 and 317 of the ground shell 30, so that the first barrel 33 is in pressure-contact with the cable holding portion 24 and the arm portion 316 and 317.

The second barrel 34 is disposed to be adjacent to the first barrel 33, and the third barrel 35 is disposed to be adjacent to the second barrel 34. Any of the barrels 34 and 35 has an approximately U-shape which protrudes in the lateral direction (the Y direction in the drawing).

The second barrel 34 is folded inward in a state of surrounding the outer conductor 53 exposed from the protective layer 54 in the coaxial cable 50, so that the second barrel 34 is in pressure-contact with the outer conductor 53. In this way, the outer conductor 53 of the coaxial cable 50 is electrically connected to the ground shell 30.

On the other hand, the third barrel 35 is folded inward in a state of surrounding the protective layer 54 of the coaxial cable 50, so that the third barrel 35 is in pressure-contact with the protective layer 54.

A flow of assembling the coaxial connector 1 according to the present embodiment will be described with reference to FIG. 2.

First, the end surface of the insulating layer 52 of the coaxial cable 50 is brought into contact with the first wall portion 13 of the contact 10, and the inner conductor 51 of the coaxial cable 50 is inserted into the insertion groove 131 of the first wall portion 13. Subsequently, in this state, the inner conductor 51 is soldered to the base portion 11 of the contact 10 (see "(a)" in FIG. 2).

Subsequently, the contact 10 is inserted into the accommodation hole 22 of the housing 20, and the coaxial cable 50 is inserted into the guide groove 241 of the housing 20 (see "(b)" in FIG. 2).

Subsequently, the housing 20 is inserted into the cylindrical portion 31 of the ground shell 30 (see "(c)" in FIG. 2), and the middle cover portion 23 of the housing 20 is folded to close the upper opening of the accommodation hole 22 (see "(d)" in FIG. 2).

Subsequently, the ground shell 30 is folded at the folding portion 321 to close the upper opening of the cylindrical portion 31 with the outer cover portion 32, and the first to third barrels 33 to 35 are closed. In this way, the coaxial connector 1 is obtained (see "(e)" in FIG. 2).

The embodiments described herein above are presented in order to facilitate understanding of the present invention and are not presented to limit the present invention. Thus, the respective elements disclosed in the above embodiments are intended to cover all design alterations belonging to the technical scope of the present invention and equivalents thereof.

EXPLANATIONS OF LETTERS OR NUMERALS

1: coaxial connector
10: contact
11: base portion
12: fitting portion
13: first wall portion
132: rear end-side surface
14: second wall portion
20: housing
21: body portion
22: accommodation hole
222: first stepped surface
224: second stepped surface
23: middle cover portion
231: rear end-side surface
30: ground shell
31: cylindrical portion
32: outer cover portion
50: coaxial cable
51: inner conductor
52: insulating layer
53: outer conductor
54: protective layer

The invention claimed is:

1. A coaxial connector comprising:

a signal conductor which is to be electrically connected to an inner conductor of a coaxial cable;

a ground conductor which is to be electrically connected to an outer conductor of the coaxial cable; and an insulator which holds the signal conductor and which is interposed between the signal conductor and the ground conductor, wherein the signal conductor includes:

a first wall portion in which an insertion portion into which the inner conductor is to be inserted is formed;

a base portion which supports the first wall portion;

a second wall portion which protrudes from the base portion in substantially the same direction as the first wall portion; and a fitting portion which protrudes from the base portion in a direction opposite to the first wall portion, the first wall portion is positioned closer to a rear end side than the fitting portion in a plan view and is disposed at least at both ends of the base portion in a direction substantially orthogonal to an axial direction of the coaxial cable, the second wall portion is positioned closer to a distal end side than the fitting portion in a plan view and is disposed at least at both sides of the base portion in the direction substantially orthogonal to the axial direction of the coaxial cable, the insulator includes:

a body portion in which an accommodation hole which accommodates the signal conductor is formed; and a middle cover portion which closes the accommodation hole, the middle cover portion is connected to the body portion so as to be able to perform a hinge operation about a direction substantially parallel to an axial direction of the coaxial cable, a rear end-side surface of the middle cover portion and a rear end-side surface of the first wall portion substantially overlap each other in a plan view, the accommodation hole includes:

a first accommodating portion which accommodates the fitting portion;

a second accommodating portion which accommodates the base portion, the first wall portion and the second wall portion; and a third accommodating portion which accommodates the middle cover portion, the accommodation hole has a stepped surface between the first accommodating portion and the second accommodating portion, the stepped surface holding a main surface of the base portion opposite to a protruding direction of the first wall portion and the second wall portion, the rear end-side surface of the first wall portion is in contact with a rear end-side inner wall surface of the second accommodating portion, a distal end-side surface of the base portion is in contact with a distal end-side inner wall surface of the second accommodating portion, and a length of the middle cover portion in an axial direction of the coaxial cable is equal to a length of the signal conductor in the axial direction.

2. The coaxial connector according to claim 1, wherein the ground conductor includes:

a cylindrical portion which accommodates the body portion;

an outer cover portion which is connected to the cylindrical portion via a folding portion, and a flat convex portion which bulges inward is formed in the outer cover portion, wherein the flat convex portion is in close contact with the middle cover portion.

3. The coaxial connector according to claim 1, wherein a contact surface of the first wall portion which contacts the middle cover portion protrudes toward the middle cover portion farther than an opposing surface of the body portion facing the middle cover portion.

* * * * *